United States Patent [19]

Pray

[11] 4,169,007

[45] Sep. 25, 1979

[54] DRYER-COOLING MACHINE FOR PRODUCING CORRUGATED DOUBLEFACE CORRUGATED BOARD

[75] Inventor: Robert W. Pray, Greenwich, Conn.

[73] Assignee: Flynn Drying System, Inc., New Rochelle, N.Y.

[21] Appl. No.: 845,589

[22] Filed: Oct. 26, 1977

[51] Int. Cl.[2] ..... B31F 1/00

[52] U.S. Cl. ..... 156/380; 34/4; 156/210; 156/272; 156/470

[58] Field of Search ..... 156/205, 208, 210, 470–473, 156/285, 272, 380; 34/4, 18, 39–41; 162/205–207

[56] References Cited

U.S. PATENT DOCUMENTS

| | | | |
|---|---|---|---|
| 2,355,671 | 8/1944 | Naeher et al. | 34/4 X |
| 3,085,143 | 4/1963 | Antoncich | 34/41 X |
| 3,183,604 | 5/1965 | Stauffer | 34/18 X |
| 3,619,325 | 1/1971 | Hair et al. | 156/359 X |

FOREIGN PATENT DOCUMENTS

| | | | |
|---|---|---|---|
| 1026808 | 4/1966 | United Kingdom | 156/205 |

*Primary Examiner*—David A. Simmons

*Attorney, Agent, or Firm*—Michael Ebert

[57] ABSTRACT

A dryer-cooling machine for combining a single face corrugated paper web whose flute peaks are wetted by lines of water-based adhesive with a liner web. The machine serves to cure the adhesive and thereby bond the webs together to form doubleface corrugated board. The singleface web and the liner web which overlies the flute peaks are transported by a conveyor belt through a heating zone and a cooling zone. In the heating zone, the belt carrying the webs passes through a funnel. Air is blown through the funnel to create in the converging region above the webs a static pressure which forces the liner into intimate contact with the flute peaks. Above this region are infrared heater elements. The wall of the funnel between the heater elements and the converging region is permeable to infrared rays whereby these rays penetrate the region and are absorbed by the liner to heat the wet adhesive, the resultant water vapors being carried away by the air flowing through the funnel. In the cooling zone, the belt passes through a duct through which cooling air is blown to lower the temperature of the webs. Emerging from the cooling zone is a web of doubleface corrugated board.

11 Claims, 5 Drawing Figures

DRYER-COOLING MACHINE FOR PRODUCING CORRUGATED DOUBLEFACE CORRUGATED BOARD

BACKGROUND OF INVENTION

This invention relates generally to doubleface corrugated paper board, and more particularly to a dryer-cooling machine adapted to combine a singleface web with a liner web and to cure the adhesive which bonds the webs together to form doubleface corrugated board.

Singleface corrugated paper board consists of a fluting ply whose troughs are laminated to a base liner. To fabricate doubleface board, a second liner must be bonded to the peaks of the fluting of the singleface board.

In a typical combining machine now in use for this purpose, the singleface web, after going through an applicator which applies wet adhesive to the peaks of the fluting, is conducted through the machine concurrently with a liner web. The combining machine includes an elongated table provided with a heater section and a cooling section. The liner web is drawn along the surface of the table with the singleface web overlying the liner web so that the flute peaks are in contact with the liner. In the heater section, the table functions as a hot plate and in the cooling section as a cold plate.

An endless cotton belt supported above the table and operating in conjunction with a row of pressure rolls serves to press the flute peaks of singleface web tightly against the liner web as these webs travel along the table to produce intimate paper contact with proper adhesive wetting. Pressure in the regions between the rolls must be sufficient to maintain paper contact during the initial stages of adhesive curing; for if the paper surfaces are permitted to separate, the fragile bond formations will be fractured and the glue line will cure with excessive bridging.

The adhesive normally used in producing doubleface board is a starch/water slurry. This slurry is transformed into a gelatinized adhesive at about 150° F. and finally into a cured adhesive after most of the water has been extracted by evaporative dehydration at 212° F. Polymer molecules form the strong crystallized structure which is characteristic of the cured adhesive.

Tests indicate that about 80 BTU's per pound of liquid adhesive are required to gelatinize the starch granules, while an additional 644 BTU's are necessary to evaporate 80% of the water. Typically, this corresponds to 2.94 BTU's to cure the doubleface glue lines in one square foot of combined board. In the conventional combining machine of the table type, this energy must be transmitted from the hot plate section through the lower liner web to reach the glue lines. As heat energy flows through this web, it heats and dries the paper fibers. Since the absorption by the paper fibers removes water from the glue line at a rather slow rate, rapid removal by evaporative boiling is essential to obtain the required bond strength at production speeds.

In combining machines of the type heretofore known, in order to produce doubleface corrugated board of good quality, the table must be long in order to afford adequate heating and cooling time, and the rate of web travel must be relatively slow in order to avoid dimensional distortion of the product. Because the lower liner web slides along the stationary table in frictional contact therewith, and the singleface web is forced thereagainst by the belt and pressure rolls which overlie this web, the webs are squeezed between the moving belt and the stationary table.

This arrangement dictates a slow speed operation; for should one attempt to pull the squeezed webs through the machine at an increased rate, this may result in extrusion and distort the product. Hence, existing combining machines for producing doubleface corrugated board of good quality are slow and inefficient in terms of productivity.

Another drawback of existing combining machines resides in the fact that should the moving webs being combined be brought to a halt on the table because of some fault in the drive mechanism or for some other reason, the heat from the heater section will then scorch the webs and render them unacceptable.

SUMMARY OF INVENTION

In view of the foregoing, the main object of this invention is to provide a compact and efficient dryer-cooling machine adapted to combine a singleface web with a liner web and to cure the adhesive which bonds the webs together to form doubleface corrugated board of good quality at a relatively rapid rate.

More particularly, it is an object of this invention to provide a machine of the above type having a heating and a cooling zone, and in which the singleface and liner webs travel through these zones on a moving belt, the webs being brought into intimate contact with each other in the heating zone by means of static air pressure, thereby obviating the need to press the webs against a stationary surface and avoiding extrusion and dimensional distortion even at production rates as high as 300 feet per minute.

A significant feature of the invention resides in a heating zone wherein infrared heaters produce rays of infrared energy which are directed through an air pressure region formed above the moving webs, the energy being absorbed by the liner web to dry and cure the web adhesive bonding the liner web to the flute peaks on the singleface web.

Also an object of this invention is to provide a machine wherein air blown through a converging funnel region formed above the moving webs in the heating zone acts to pick up and rapidly remove the vapors evaporated from the wet adhesive, thereby accelerating the drying process and making possible a combining machine of relatively short length.

Briefly stated, these objects are attained in a machine in accordance with the invention for combining a singleface corrugated paper web with a liner web, the flute peaks of the singleface web entering the machine being wetted with lines of water-based adhesive.

In the machine, the singleface web and the liner web which overlies the wet flute peaks are transported by a conveyor belt through a heating zone and a cooling zone. In the heating zone, the belt carrying the webs passes through a funnel. As a result of the flow restriction defined by the converging region of the funnel above the webs, air blown through the tunnel produces a static pressure therein which exerts a force that brings the liner web into intimate contact with the wet flute peaks.

Supported above the converging funnel region is an array of infrared heater elements, the wall of the funnel between this array and the region therebelow being permeable to infrared rays whereby the rays penetrate the region and are absorbed by the liner web to heat and cure the wet adhesive and thereby bond the webs together. The resultant water vapors are carried away by the air flowing through the funnel to expedite the drying process.

In the cooling zone, the belt carrying the heated webs passes through a duct through which dry cooling air is blown to lower the temperature of the webs, whereby emerging from the cooling zone is a web of doubleface corrugated board.

OUTLINE OF DRAWINGS

For a better understanding of the invention as well as other objects and further features thereof, reference is made to the following detailed description to be read in conjunction with the accompanying drawings, wherein:

FIG. 1 schematically shows a system including a dryer-cooling machine in accordance with the invention for producing doubleface corrugated board;

DESCRIPTION OF INVENTION

The System

Figure 1:
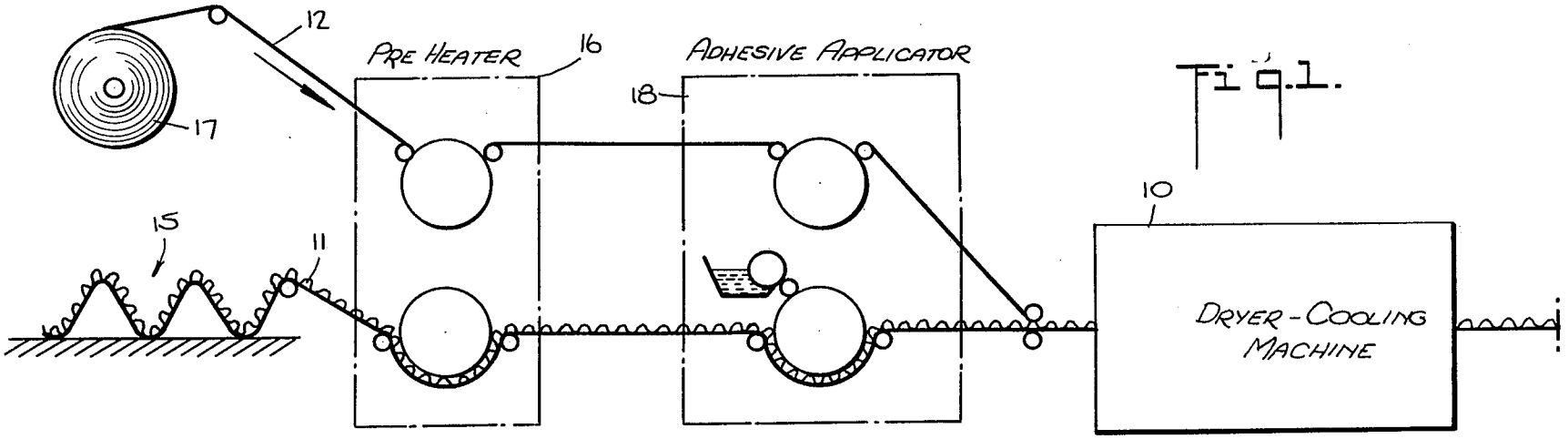

Referring now to FIG. 1, there is shown a system for producing doubleface corrugated board, the system including a dryer-cooling machine in accordance with the invention, generally designated by numeral 10.

Figure 2:
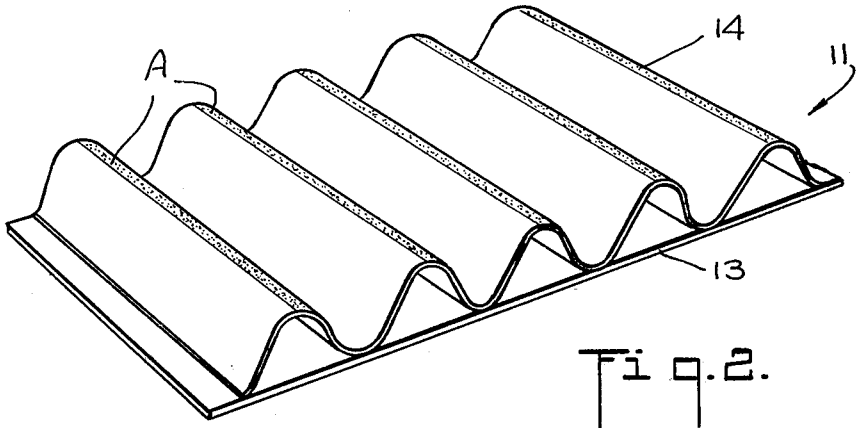
FIG. 2 is a perspective view of a singleface web showing the lines of wet adhesive on the peaks of the fluting ply.

Fed into machine 10 is a web 11 of singleface material and a web 12 of liner material. Singleface web 11, as shown separately in FIG. 2, is composed of a base liner 13 and a fluted ply 14, the troughs of which are laminated to base liner 13. The manner in which the singleface web is produced forms no part of the present invention.

In a system for producing doubleface corrugated paper board, the web 11 of singleface material is drawn from a source 15 and fed through a pre-heater stage 16. Concurrently fed into pre-heater stage 16 is the web 12 of liner material, this web being unwound from a supply roll 17. Pre-heater stage 16 serves to raise the temperature of both webs somewhat above ambient temperature, so that the webs enter the dryer-coater machine 10 in a relatively warm state. But before the webs enter the machine, they pass through an adhesive applicator stage 18 where lines of wet adhesive A are applied to the peaks of the flutes of ply 14 of singleface web 11.

Figure 3:
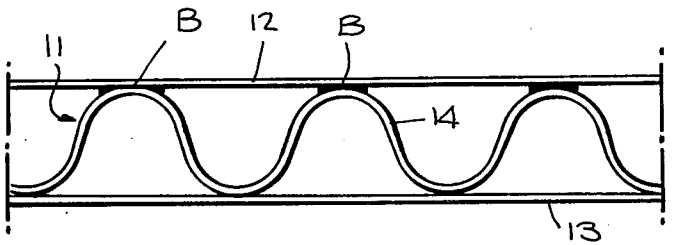
FIG. 3 is a section taken through the doubleface board.

From adhesive applicator stage 18, webs 11 and 12 pass into combining machine 10 with liner 12 overlying the wetted flute peaks of singleface web 11. In the machine, liner 12 is brought by static air pressure into intimate contact with the flute peaks, the webs being transported by a conveyor belt through a heating zone in which the adhesive is cured to effect a bond between the webs and a cooling zone in which the temperature of the combined webs is reduced. Thus emerging from machine 10 is a doubleface corrugated board, as shown in FIG. 3, in which the flute peaks of ply 14 are strongly bonded to liner 12 by cured lines of adhesive B.

The Machine

Figure 4:
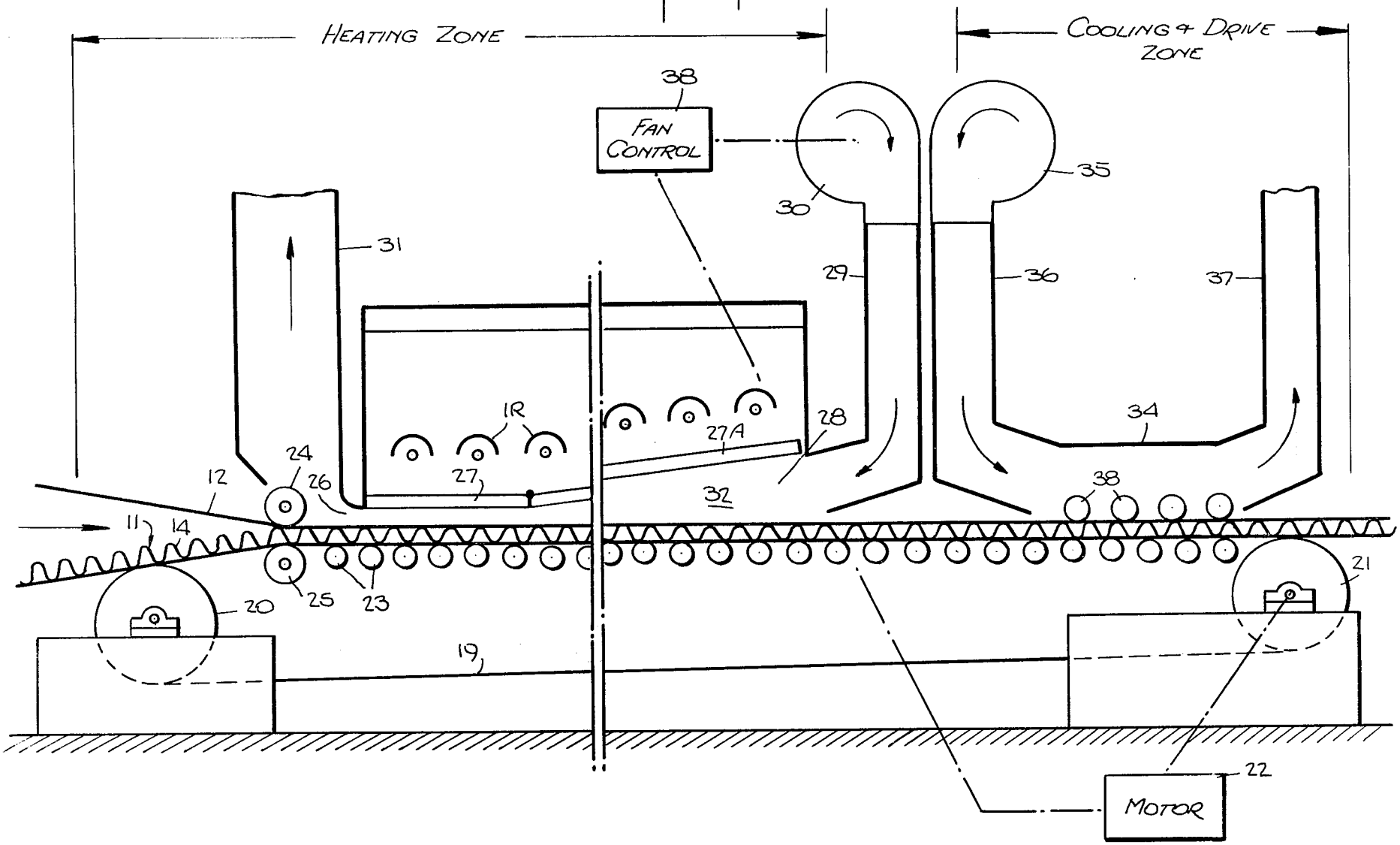
FIG. 4 is a schematic drawing of a machine in accordance with the invention.
Figure 5:
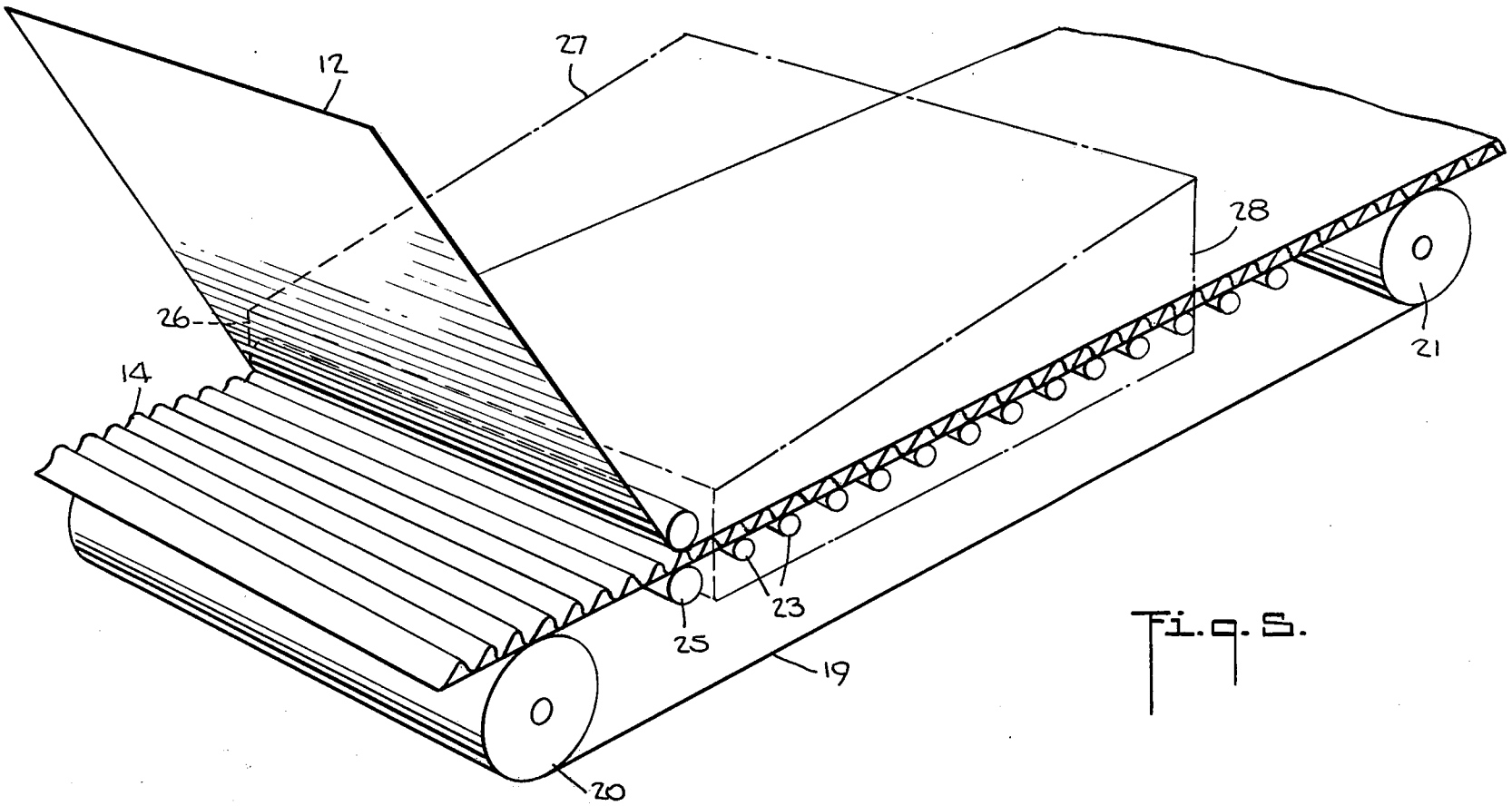
FIG. 5 is a perspective view of the heating zone of the machine.

Machine 10, as shown in FIGS. 4 and 5, transports singleface web 11 and liner web 12 through a heating zone and a cooling zone by means of an endless conveyor belt 19 supported between rollers 20 and 21. In practice, belt 19 is preferably formed of stainless steel and is driven by a motor 22 operatively coupled to roller 21. Supporting the upper reach of belt 19 to maintain this reach in a horizontal plane is a series of idler rolls 23. The input nip to the conveyor for the webs is defined by a pair of input rolls 24 and 25.

The web feed arrangement is such that base liner 13 of the singleface web rests on the surface of belt 19, whereas the liner web 12 overlies the wet peaks of fluting ply 14.

In the heating zone, the upper reach of conveyor belt 19 passes into the spout 26 of a funnel 27 having a rectangular cross-section. The breadth of the funnel is just sufficient to accommodate the belt. The height of the funnel decreases progressively from a relatively large inlet mouth 28 thereof to the narrow outlet spout 26. Coupled to mouth 28 of the funnel means of a conduit 29 is a blower fan 30 which functions to force air through the funnel, the air being discharged from the funnel through spout 26 into an exhaust conduit 31.

Because of the converging region 32 defined by the funnel between the mouth and spout, the funnel acts as a flow restriction to produce a static pressure within this region. This pressure imposes a force on liner 12, bringing this liner into intimate contact with the wet lines on the flute peaks of ply 14 of the singleface web 11. Thus the funnel creates a pneumatic hold-down pressure on the webs transported through the funnel on belt 19. However, no extrusion occurs because of this pneumatic hold-down pressure; for the interface between moving liner 12 and the static pressure applied thereto is not a solid surface but a fluid which does not resist web movement.

Disposed within a compartment whose base is defined by the inclined upper wall 27A of funnel 27 is an array of infrared heater elements IR. The term "infrared" is applied to wavelengths of radiant energy between 760 mμ and 1 mm, the beginning of the microwave band. Because glass and the carbon dioxide in the atmosphere are increasingly opaque to wavelengths higher than 4000 mμ, shorter wavelengths are generally used in designing infrared emitters.

Conventional infrared emitters, such as the General Electric Type T-3 emitter, produce a significant component of visible light as well as infrared radiation, and they radiate mainly in the near infrared region. Hence when the rays from a source of this type strike a paper liner, the rays are in large measure reflected thereby rather than absorbed to generate heat. Use is, therefore, preferably made of an infrared source such as one in which the emitters are broad ceramic emissive surfaces which radiate no visible light but which produce infrared rays in the far infrared region (i.e., from 2.6 microns to 3.5 microns). The advantage of such emitters is that the rays emitted therefrom are mainly absorbed by the paper liner and therefore function as more efficient dryers for the wet adhesive to be cured.

The upper wall 27A of funnel 27 is formed of a material such as quartz, which is impermeable to air and hence does not disturb the integrity of the funnel, but is permeable to infrared radiation, so that the rays from the emitters pass through the converging region of the funnel and strike the surface of liner 12.

The infrared rays from heater elements IR are concentrated by reflectors or radiated from broad emissive surfaces which direct the rays through the converging funnel region 32 which absorbs the infrared energy to produce heat which acts on the wet adhesive lines. Since the heater elements are in a row extending in the direction of web movement, the moving liner is made progressively hotter as it advances through the heating zone.

The effect of heat on the starch/water slurry which forms the wet lines on the flute peaks will now be explained. At room temperature, the starch granules are suspended in water and exhibit no affinity for each other. In this state, the polymer molecules remain bound within the granule's structure. These internal bonds are disrupted upon heating the granules to approximately 150° F., and each granule then absorbs a quantity of water several times greater than its dry weight so that the granules swell.

In this hydrated condition, a portion of the polymer molecules are released by the swelling molecules. These polymer molecules within the gelatinized adhesive are free to move about and to form stronger linkages with polymer molecules from other granules. As the webs advance through the heating zone and the temperature rises, moisture is evaporated from the adhesive and the final dehydration phase begins. When the water leaves the glue lines on the flute peaks, the polymer molecules are brought into close contact with each other and they recombine to form a strong crystalline structure in the cured state.

The strength of the bond is enhanced as water is removed. Since absorption by the paper fibers of the liner and the fluting extracts water from the glue line at a rather slow rate, rapid removal by evaporative boiling is essential to produce the desired bond strength at high production speeds. The rapid removal of water vapor is expedited by the air stream passing through the funnel, for this stream picks up the vapors and discharges it into the atmosphere through outlet conduit 31.

From the heating zone, conveyor belt 19 carries webs 11 and 12 through a duct 34 having a rectangular cross-section to the inlet of which is supplied cool air which is preferably dry. This air is forced by a blower fan 35 into the inlet of the duct by way of a conduit 36, the outlet of the duct being coupled to a discharge flue 37.

Hold-down pressure in the cooling zone is provided by a series of rolls 38. Since the combined webs entering the cooling zone are in bonded condition, the resultant doubleface web is strong and resistant to pressure forces. Hence in this cooling zone, hold-down rolls may be used without adversely affecting the doubleface structure.

In practice, the hold-down rolls in the cooling zone may be driven, thereby doing away with the need for external drive means to pull the webs through the machine. The motor speed for controlling web advance is adjustable, and the blower fans are also of variable speed to adjust the flow ratio of the air forced through the funnel in the heating zone and the duct in the cooling zone. In addition, controls may be provided in conjunction with the IR heater elements to vary the number of elements which are operative and to adjust the operating power to control the intensity of radiation. In this way, all operating parameters of the machine may be adjusted to attain optimum web combining conditions.

Under some circumstances, it may be necessary to stop the conveyor, or the conveyor may be arrested as a result of some defect in the drive system, as a consequence of which the webs are then stationary. In accordance with the present invention, there is no danger that the stationary webs, which are still being subjected to infrared radiation, will become scorched thereby, for means are provided to automatically increase the volumetric flow of air in the event of stoppage.

Such means take the form of a fan control device 38 operatively coupled to fan motor 30 and responsive to a stoppage of driver motor 22 or to any other factor indicative of a stationary conveyor condition, to step up the speed of the fan motor 30 to increase volumetric flow. Alternatively, an auxiliary fan may be provided to increase volumetric air flow through the funnel when a stoppage is sensed. The heat sink effect of the air above the liner then serves to thermally balance the temperature of the liner surface during the stop period and to maintain the liner temperature below the point of scorch.

Also, in practice, an interlock may be provided to shut off the IR element whenever the conveyor is halted and remains in this state for a predetermined period. Since IR elements of the preferred type have a fairly slower warm-up period, it is not desirable that these IR elements be shut off when a momentary conveyor halt is encountered; for then even after the conveyor has resumed operation, the IR elements take time to reach their normal operating levels.

While there has been shown and described a preferred embodiment of a dryer-cooling machine for producing doubleface corrugated board in accordance with the invention, it will be appreciated that many changes and modifications may be made therein without, however, departing from the essential spirit thereof. For example, while the machine disclosed above is designed for use with conventional water/-starch adhesives which require heat to cure, use can also be made of cold set adhesives which require no heaters, in which case the heating zone, by reason of the air funnel effect, functions only as a hold-down zone.

I claim:

1. A machine for combining a web of singleface corrugated paper with a web of liner paper to effect an adhesive bond between the flute peaks of the single face web and the surface of the liner web to form doubleface corrugated board, said machine comprising:

(A) a conveyor to transport the webs through a funnel having a large mouth converging toward a relatively narrow spout in a hold-down zone, the liner web overlying the flutes of the singleface web, said conveyor being constituted by an endless belt whose upper reach passes through said funnel;

(B) means to force air into the mouth of said funnel and to exhaust the air from the spout thereof at a rate producing a static pressure in the converging region of said funnel above the advancing webs, thereby imposing a force on the liner web to maintain it in intimate contact with the flute peaks which carry lines of adhesive; and (C) an infrared heater above the upper wall of the funnel, said wall being impermeable to air and being permeable to infrared rays whereby the rays penetrate the region to heat the liner and to effect curing of the adhesive, whereby said hold-down zone also functions as a heating zone, the air passing through the funnel picking up vapors emitted from the drying adhesive and discharging these vapors through said spout.

2. A machine as set forth in claim 1, further including a cooling zone through which the belt passes after leaving the heating zone to lower the temperature of the webs.

3. A machine as set forth in claim 1, wherein said funnel has a rectangular cross-section whose width is sufficient to accommodate the belt.

4. A machine as set forth in claim 1, further including idler rolls below said upper reach of belt to maintain the belt in a horizontal plane.

5. A machine as set forth in claim 1, wherein said upper wall is formed of quartz.

6. A machine as set forth in claim 5, wherein said heater is formed by an array of heater elements to cause said liner to become progressively hotter as it advances through the heating zone.

7. A machine as set forth in claim 1, wherein said cooling zone includes a duct through which the conveyor passes, and means to feed cooling air through said duct.

8. A machine as set forth in claim 1, wherein said heater emits infrared rays in the far infrared region.

9. A machine as set forth in claim 8, wherein said region is from about 2.6 to 3.5 microns.

10. A machine as set forth in claim 1, further including means responsive to a stoppage of the conveyor to increase the volume of air forced into the mouth of the funnel to prevent scorching of the webs.

11. A machine as set forth in claim 10, further including interlock means to cut off the infrared heater in the event of a stoppage of the conveyor.

* * * * *